US007207814B2

(12) United States Patent
Chen et al.

(10) Patent No.: US 7,207,814 B2
(45) Date of Patent: Apr. 24, 2007

(54) ELECTRICAL CARD CONNECTOR

(75) Inventors: Kun-Hua Chen, Tu-Cheng (TW); Yung-Chien Chung, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/323,732

(22) Filed: Dec. 30, 2005

(65) Prior Publication Data

US 2006/0286870 A1 Dec. 21, 2006

(30) Foreign Application Priority Data

Jun. 17, 2005 (TW) ..... 94120173 A

(51) Int. Cl.
*H01R 24/00* (2006.01)

(52) U.S. Cl. ..... 439/159

(58) Field of Classification Search ..... 439/637, 439/638, 131, 630, 331, 159, 64, 923, 160, 439/152, 157
See application file for complete search history.

(56) References Cited

U.S. PATENT DOCUMENTS 6,685,490 B1 2/2004 Xue et al.
7,128,589 B1 * 10/2006 Hsu ..... 439/159
2001/0055897 A1 * 12/2001 Nogami ..... 439/159
2004/0259400 A1 * 12/2004 Chang ..... 439/159
2005/0085114 A1 * 4/2005 Su et al. ..... 439/159
2005/0221649 A1 * 10/2005 Tanaka et al. ..... 439/159

* cited by examiner

*Primary Examiner*—J. F. Duverne
(74) *Attorney, Agent, or Firm*—Wei Te Chung

(57) ABSTRACT

An electrical card connector (100) includes a housing (1) having a rear wall (11), and first and second side walls (12 and 13) substantially parallel extending forwards form the rear wall; a shielding member (5) covering on the housing and defining a receiving cavity together with the first and second side walls for receiving an electrical card (6), the receiving cavity having a font entry from which the electrical card is inserted into the receiving cavity; and a number of terminals (2) disposed in the housing and each having a contact portion (22) extending into the receiving cavity for contacting the electrical card. The shielding member is provided with a pair of guiding plates (56) at the front entry of the receiving cavity and disposed between the first and second side walls for guiding the electrical card into the receiving cavity.

7 Claims, 9 Drawing Sheets

ELECTRICAL CARD CONNECTOR

BACKGROUND OF THE INVENTION

1. Field of the Invention

The present invention relates to an electrical card connector, specifically to a card connector provided for electrically connecting a card to a circuit board.

2. Description of Related Art

In electronic appliances, such as portable telephones, PDA, cameras and the like, various expandable functions are achieved by installing IC cards, such as SIM (subscriber identify module) card, MMC (multimedia card), SD (secure digital) card, MS (memory stick) card and the like therein. Such an IC card is usually connected to the circuit board via a card connector.

FIG. 9 of the attached drawings shows a conventional card connector (shown as U.S. Pat. No. 6,685,490) including an insulative housing 3, a plurality of first terminals 5 and second terminals 6 retained in the insulative housing 3, a shielding member 2 covering on top of the insulative housing 3, and an ejector 4 positioned on one side of the insulative housing 3 for realizing ejection of a card. The insulative housing 3 has a rear wall 31 and a pair of side walls 32, 33 parallel extending forwards form the rear wall 31 and defining a receiving space 34 therebetween. For guiding an IC card into the receiving space 34, a pair of guiding slots 323 and 333 are provided on the side walls 32 and 33 respectively. While the IC card is sliding in the guiding slots 323 and 333, the side periphery of the IC card rubs against the bottom surface of the slots 323 and 333. However, as both the periphery of the IC card and the insulative housing 3 are made from a plastic material, the rub therebetween is rather considerable, especially when the IC card is required to do repeated insertion or ejection movement in the card connector. Such rub cause too much wear to both the IC card and the insulative housing 3, and therefore reduce engagement precision between the IC card and the insulative housing 3.

Therefore, an improved card connector is desired to overcome the disadvantages of the prior arts.

SUMMARY OF THE INVENTION

An object of the present invention is to provide a card connector in which wear damage due to insertion or ejection movement of IC cards can be reduced.

In order to achieve above-mentioned object, an FPC connector in accordance with a preferred embodiment of the present invention includes a housing having a rear wall, and first and second side walls substantially parallel extending forwards form the rear wall; a shielding member covering on the housing and defining a receiving cavity together with the first and second side walls for receiving an electrical card, the receiving cavity having a font entry from which the electrical card is inserted into the receiving cavity; and a plurality of terminals disposed in the housing and each having a contact portion extending into the receiving cavity for contacting the electrical card. The shielding member is provided with a pair of guiding plates at the front entry of the receiving cavity and disposed between the first and second side walls for guiding the electrical card into the receiving cavity.

Other objects, advantages and novel features of the present invention will become more apparent from the following detailed description of the present embodiment when taken in conjunction with the accompanying drawings.

DETAILED DESCRIPTION OF THE INVENTION

Figure 1:
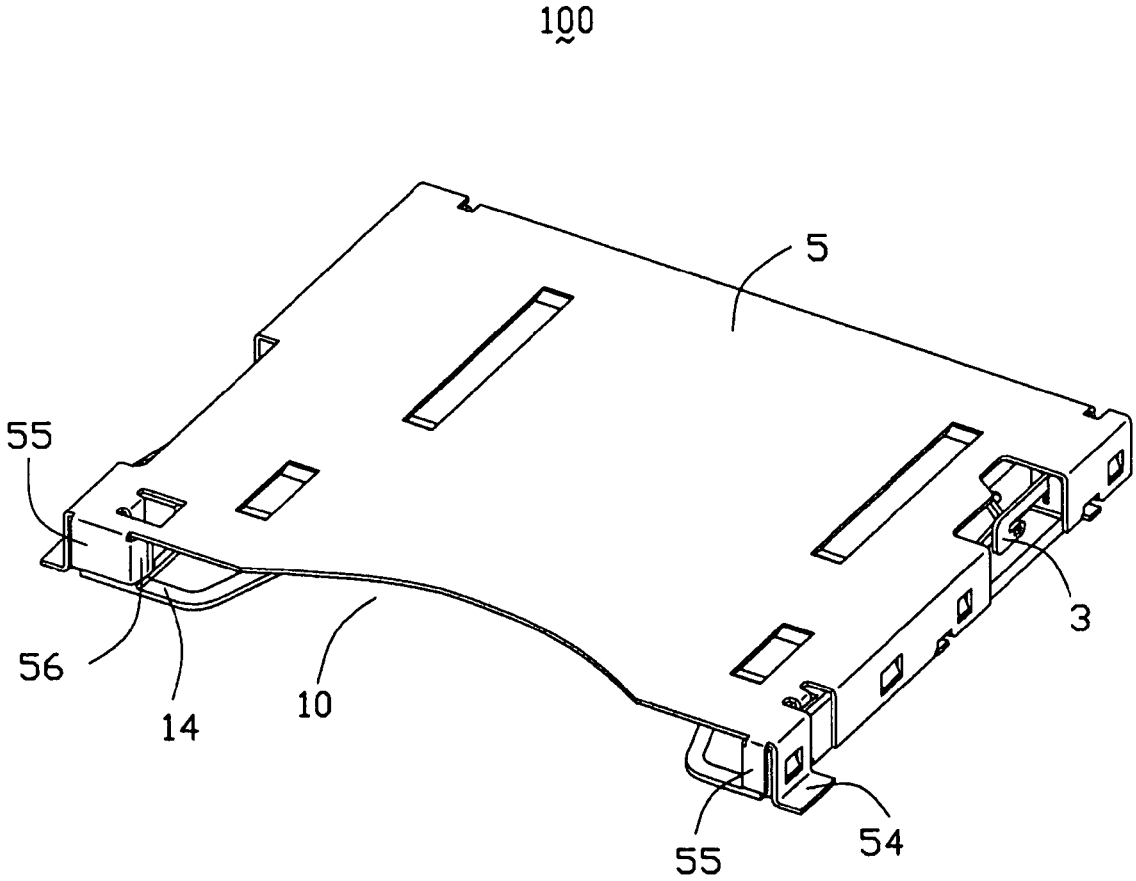
FIG. 1 is an assembled perspective view of a card connector in accordance with the preferred embodiment of the present invention.
Figure 2:
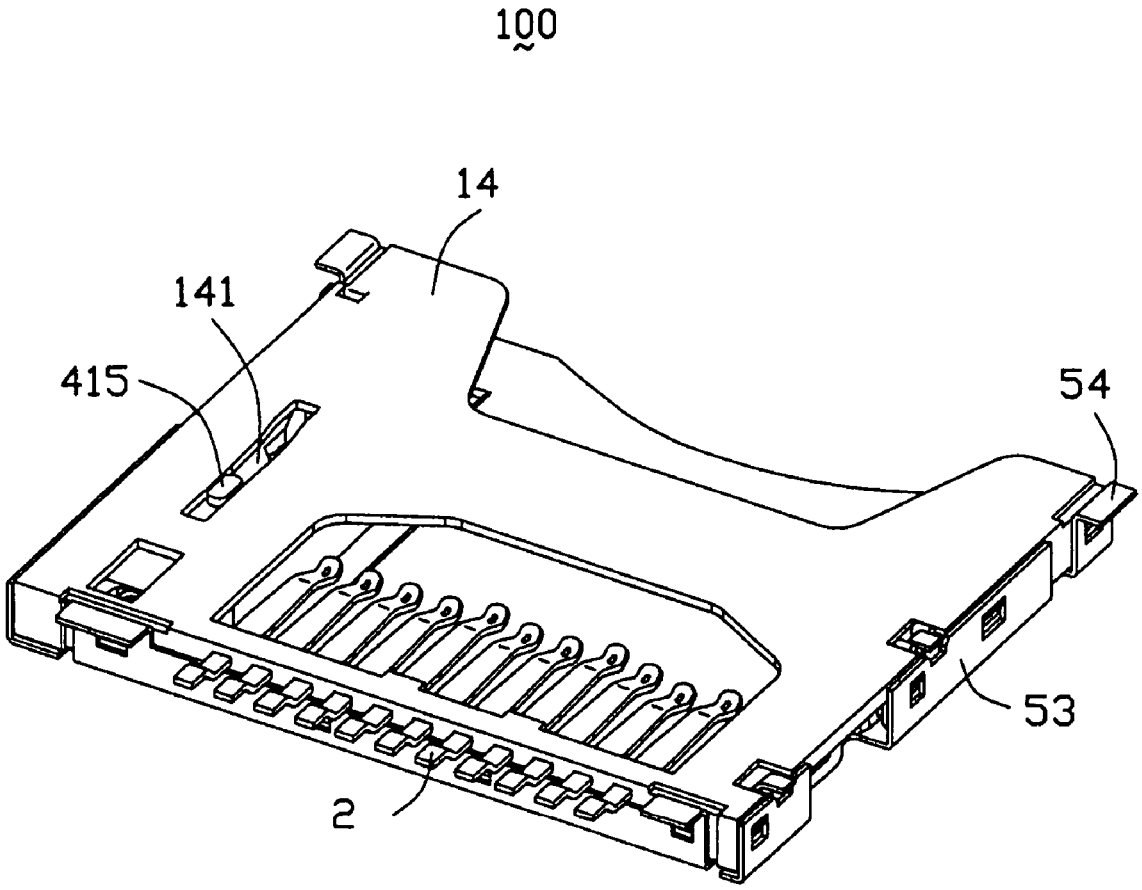
FIG. 2 is another assembled perspective view of the card connector of FIG. 1 taken from an aspect different from that of FIG. 1.
Figure 3:
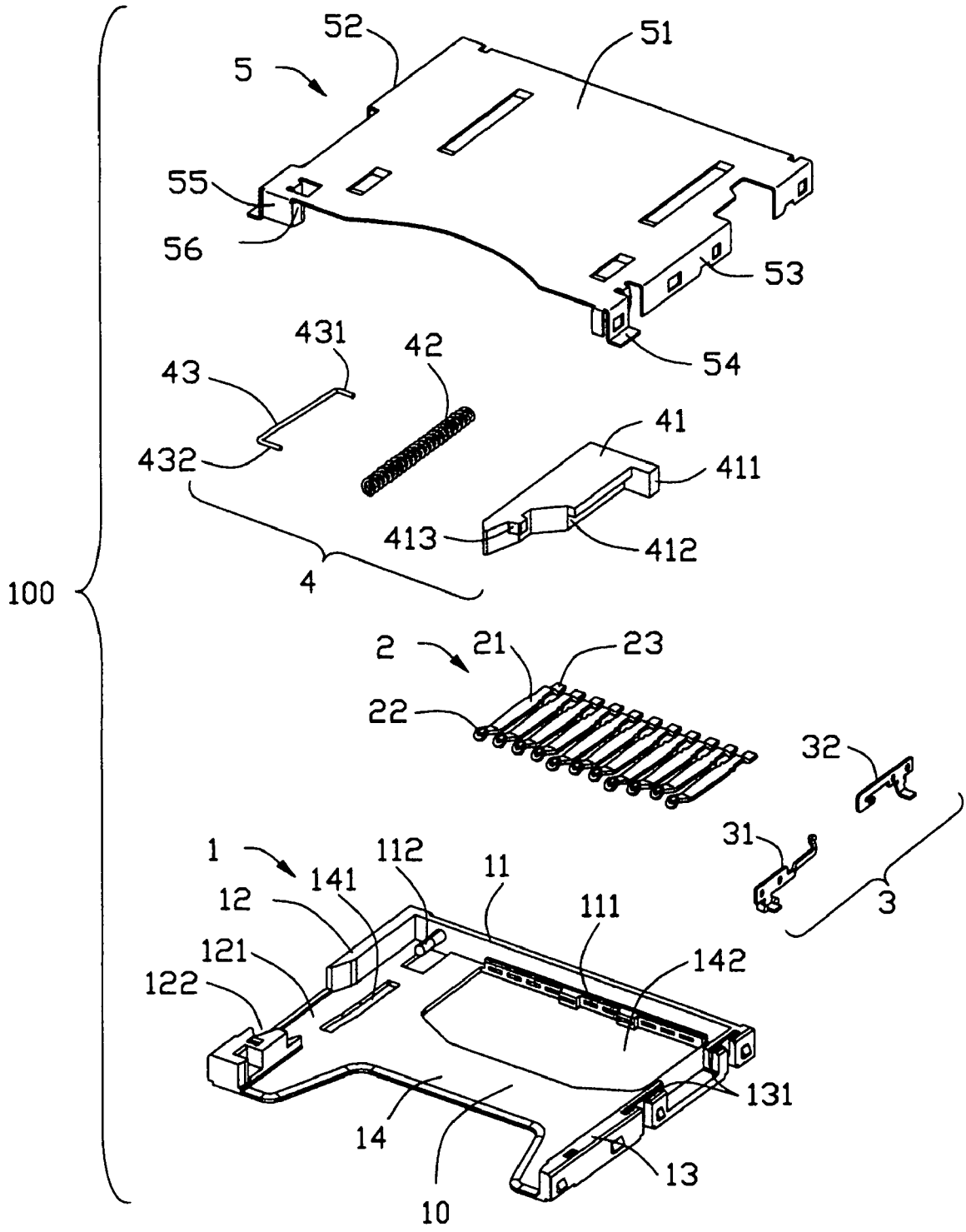
FIG. 3 is an exploded, perspective view of the card connector of FIG. 1.

Reference will now be made to the drawing figures to describe the preferred embodiment of the present invention in detail.

Referring to FIGS. 1–6, a card connector 100 for connecting a card 60 (shown in FIG. 6) to a circuit board (not shown) in accordance with the preferred embodiment of the present invention comprises an insulative housing 1, a plurality of contact terminals 2 received in a rear portion of the housing 1, a switch terminal 3 received in one side of the housing 1, an ejector 4 received in the other side of the housing 1, a shielding member 5 covering on top of the housing 1.

The housing 1 has a rear wall 11, a first side wall 12, a second side wall 13 and a bottom wall 14, all of which define an upward opening 10 together. The rear wall 11 has a plurality of contact terminal receiving slots 111 for receiving the plurality of contact terminals 2. A post 112 is formed on the rear wall 11 adjacent to the first side wall 12 and extends forwardly into the opening 10. The first side wall 12 defines a recess 121 having an acuminate portion 122. The second side wall 13 defines a switch terminal receiving recess 131 for receiving the switch terminal 3. The bottom wall 14 defines a through slot 141 adjacent to the recess 121 for engaging with the ejector 4 and a through area 142 adjacent to the contact terminal receiving slots 111 for providing a space for the contact terminals 2 to perform elastic deflection while the card 6 being inserted in the opening 10.

Each of the contact terminal 2 comprises a retaining portion 21, a contact portion 22 extending forwards from the retaining portion 21 and a solder portion 23 extending rearwards from the retaining portion 21. The switch terminal 3 is used for detecting whether the card 6 is completely assembled, and includes a first terminal 31 and a second terminal 32 which can be either connected together or separate from each other. As the switch terminal is a well-known technique used in card connectors, unnecessary details about it will not be given here.

The ejector 4 comprises a slider 41, a spring 42, and a slider rod 43. The slider 41 has an L-shaped main body and defines a pushing block 411 and a guide passage 412. The front end of the slider 41 is formed into an acuminate tip shape for fitly engaging with the acuminate portion 122 of the recess 121 of the housing 1. There are a lock protuberance 413 formed at a front section of the main body for locking the card 6, a groove 414 (shown in FIG. 5) formed in an exterior side surface of the main body for receiving a first end 431 of the slider rod 43 which is slidable therein, a rib 415 (shown in FIG. 2) formed on a bottom surface of the main body for moving within the through slot 141 of the housing 1, and a spring fixing hole (not labeled) defined in a rear surface of the main body for receiving and fixing one end of the spring 42, the other end of which is fixed on the post 112. The spring 42 enables the slider 41 to move in a sliding direction in response to insertion of the card 6 and slides between a forward position whereat the card 6 is not inserted and a back position whereat the card 6 is inserted.

The shielding member 5 has a top wall 51, a first side edge 52 and a second side edge 53 respectively attached to the first side wall 12 and the second side wall 13 of the housing 1, wherein the first side edge 52 is provided with a deflectable latch 521 adapted for abutting against the slider rod 43 to preventing it from being detached from the slider 41. Both the first and second side edges 52, 53 define a plurality of retaining slots (not labeled) for engaging with protrusions formed on periphery surfaces of the side wall 12, 13, so as to retain the shielding member 5 to the housing 1. The shielding member 5 further has a pair of solder plates 54 respectively bent from the side edge 52 and 53 adjacent to the front side thereof, and a pair of front shielding plate 55 integrally bent down from the top wall 51 and shielding the front surface of the side wall 12 (or 13) and a slide-guiding plate 56 bent inwardly from the front shielding plate 55 for guiding slide movement of the card 6 while the card 6 being inserted into the card connector 100.

Figure 4:
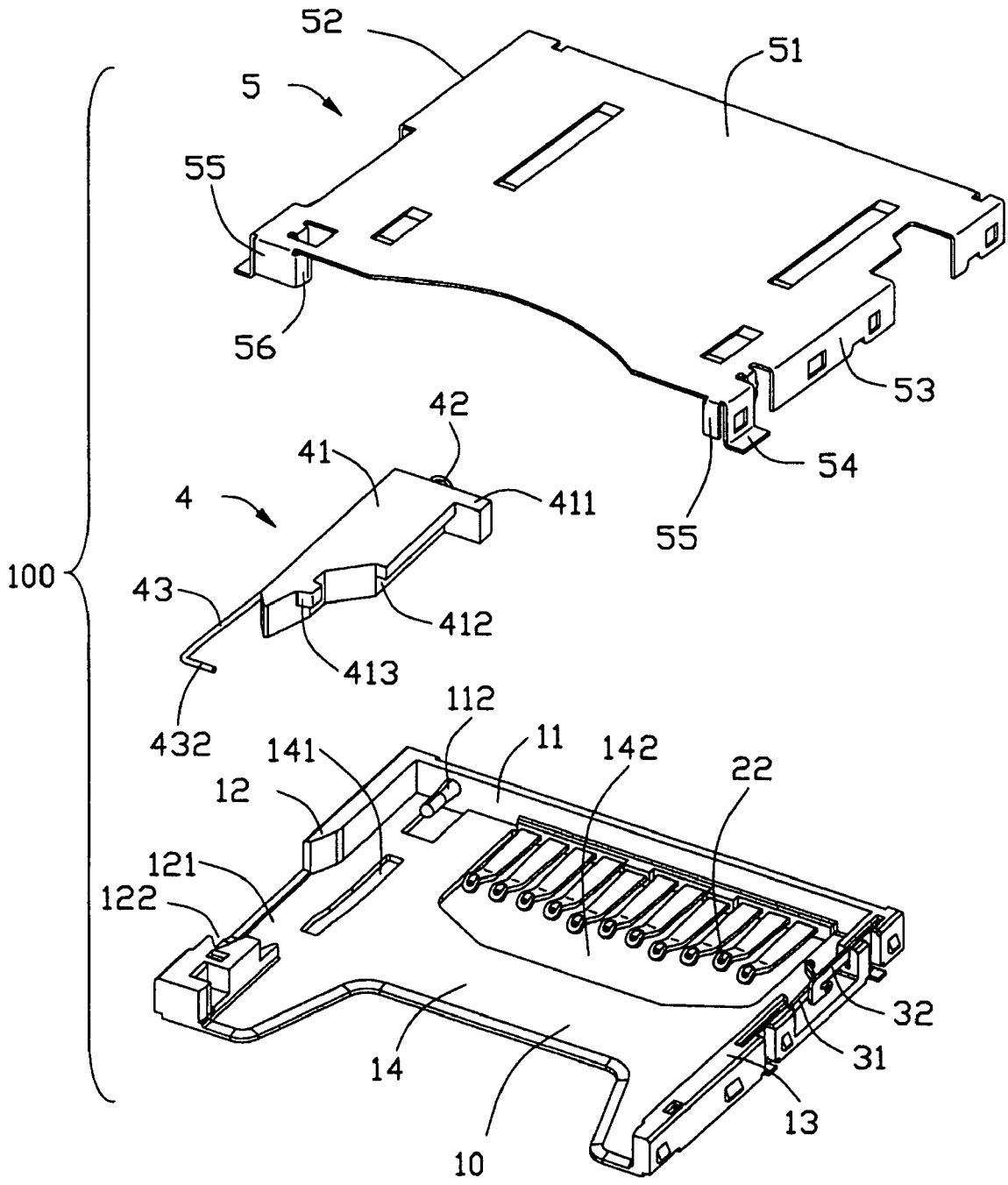
FIG. 4 is a partly assembled view of the card connector of FIG. 3, wherein the terminals are assembled in the housing, and the spring slider rod are assembled in the slider.
Figure 5:
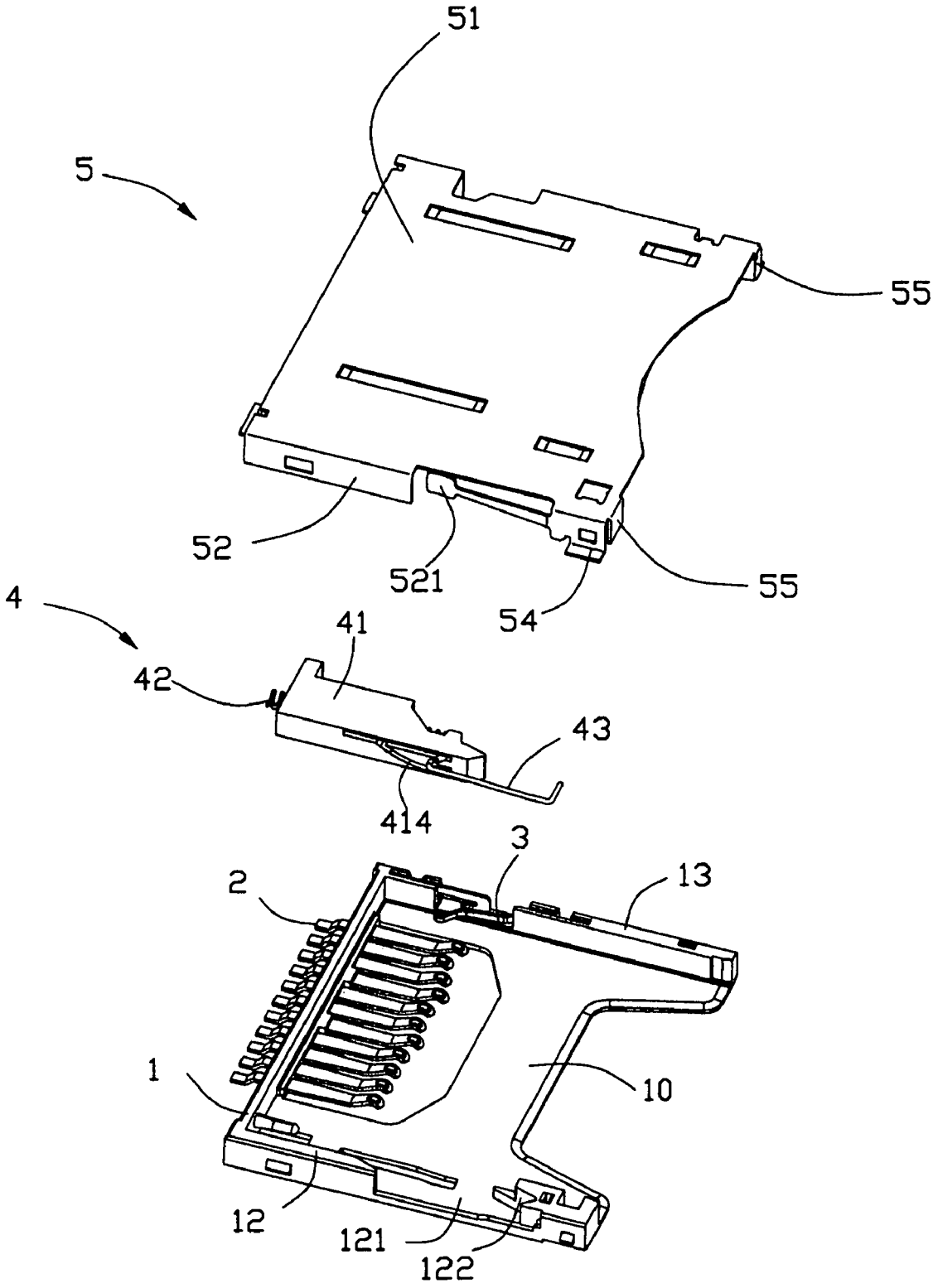
FIG. 5 is a view similar to FIG. 4 but taken from a different aspect.
Figure 6:
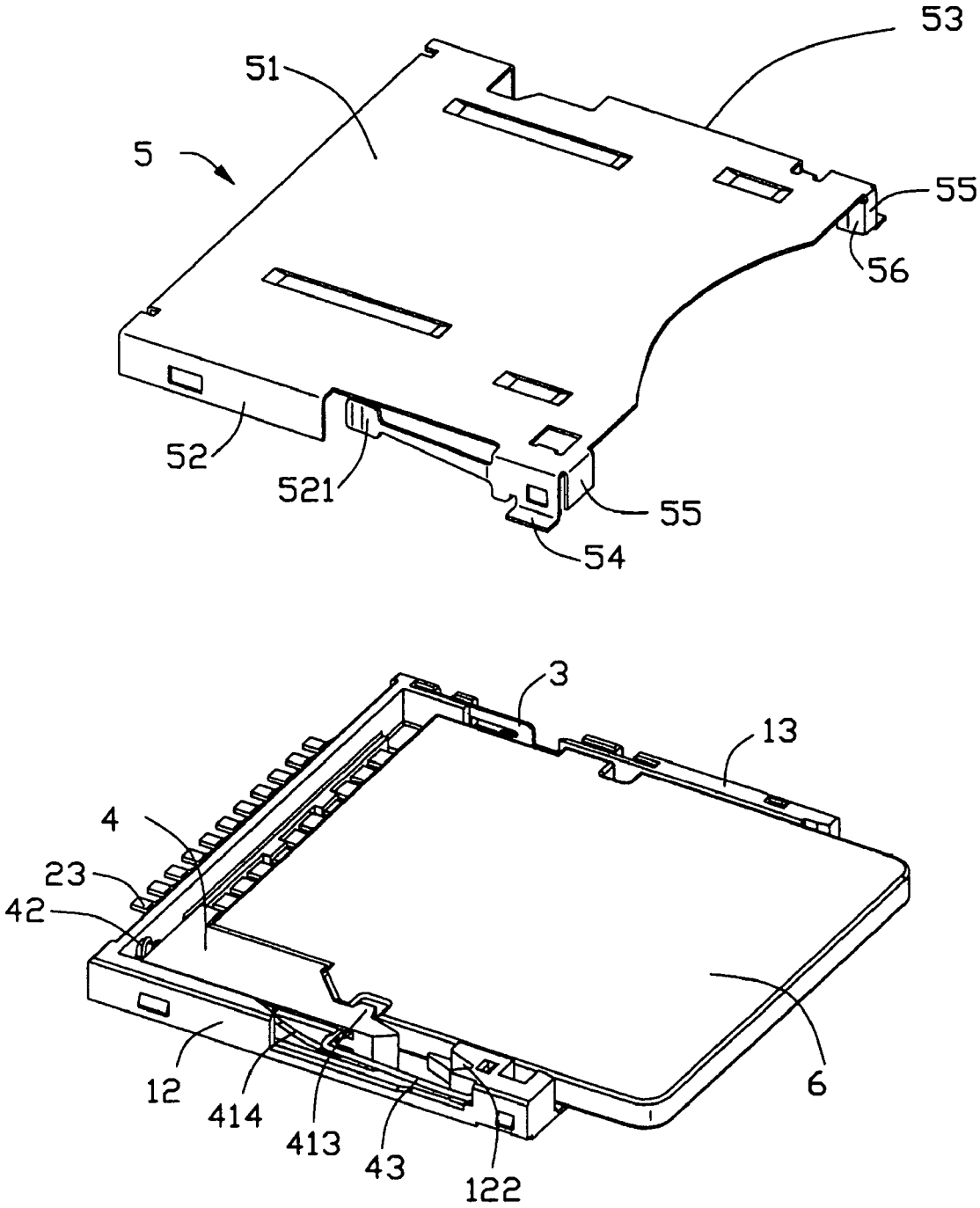
FIG. 6 is a view illustrating the card connector of FIG. 4 being further assembled, and further illustrating a card.

Mainly referring to FIGS. 4–6, in assembly, the contact terminals 2 is firstly assembled into the contact terminal receiving slots 111 at the rear wall 11. Then the switch terminal 3 is fixed into the switch terminal receiving recess 131 at the second side wall 13. Then the ejector 4 is mounted to the housing 1 with the acuminate tip of the slider 41 received in the acuminate portion 122 of the recess 121, the spring 42 fixed on the post 112, the slider rod 43 having a second end 432 thereof fixed into a corresponding hole (not labeled) defined in the first side wall 12. Lastly, the shielding member 5 is disposed on top of the housing 1 so as to covering the opening 10 to form a forwards opened card receiving cavity for fitly receiving the card 6.

Figure 7:
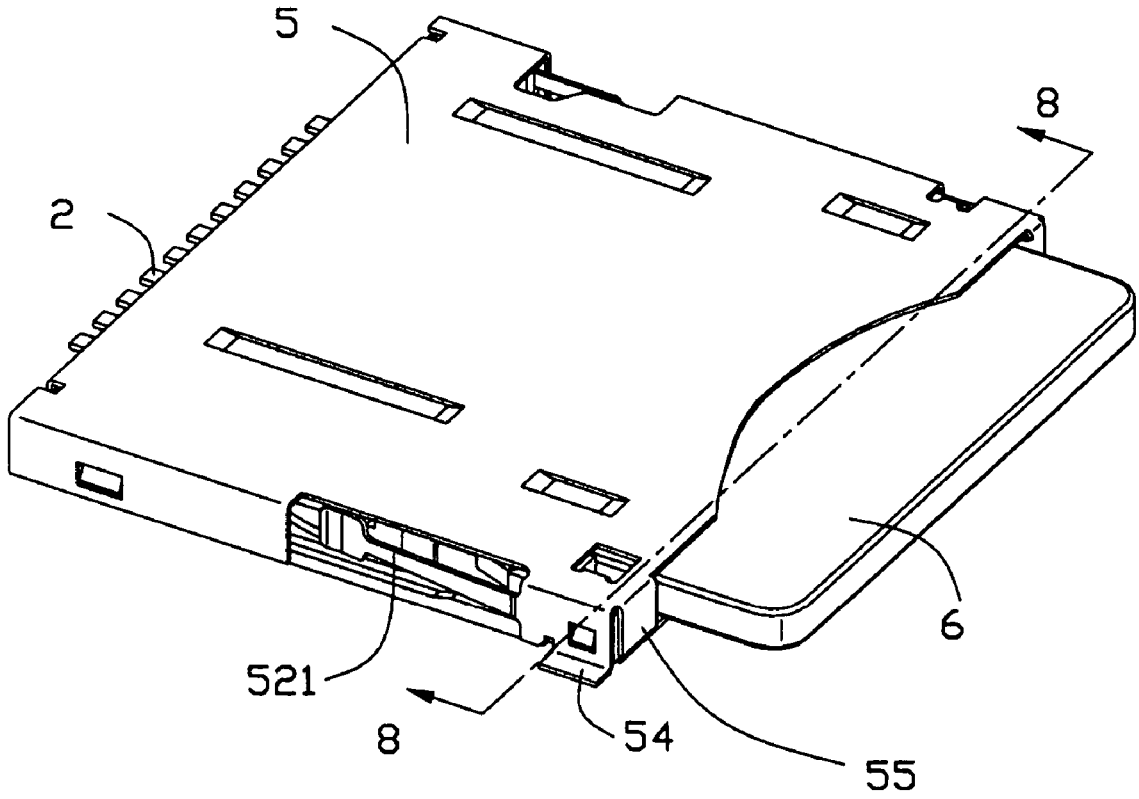
FIG. 7 is a view showing the card connector of FIG. 6 being completely assembled, and the card is inserted in the card connector.
Figure 8:
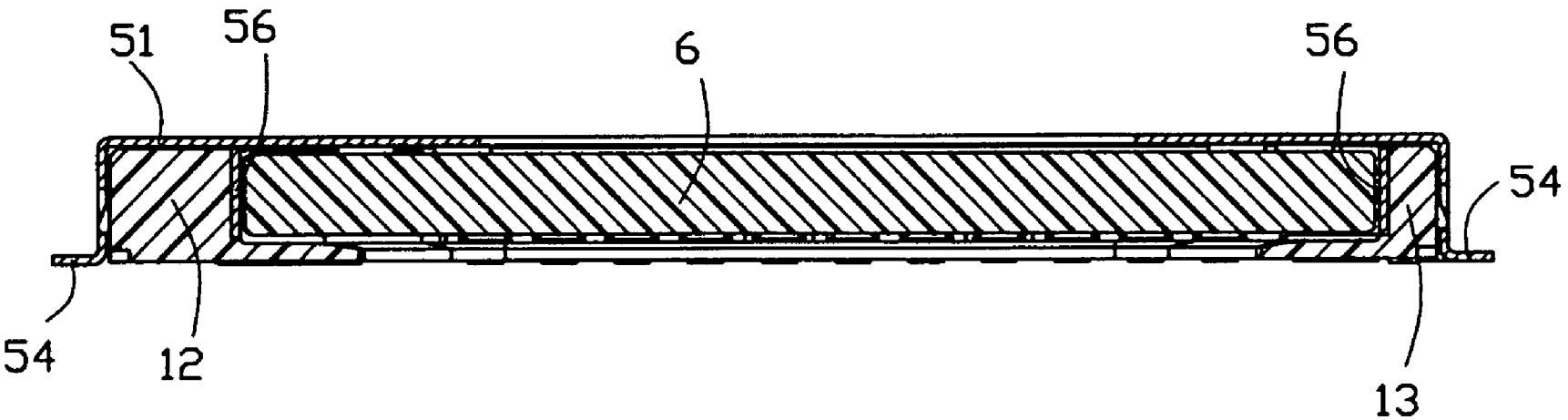
FIG. 8 is a cross-sectional view of FIG. 7 along 8—8.
Figure 9:
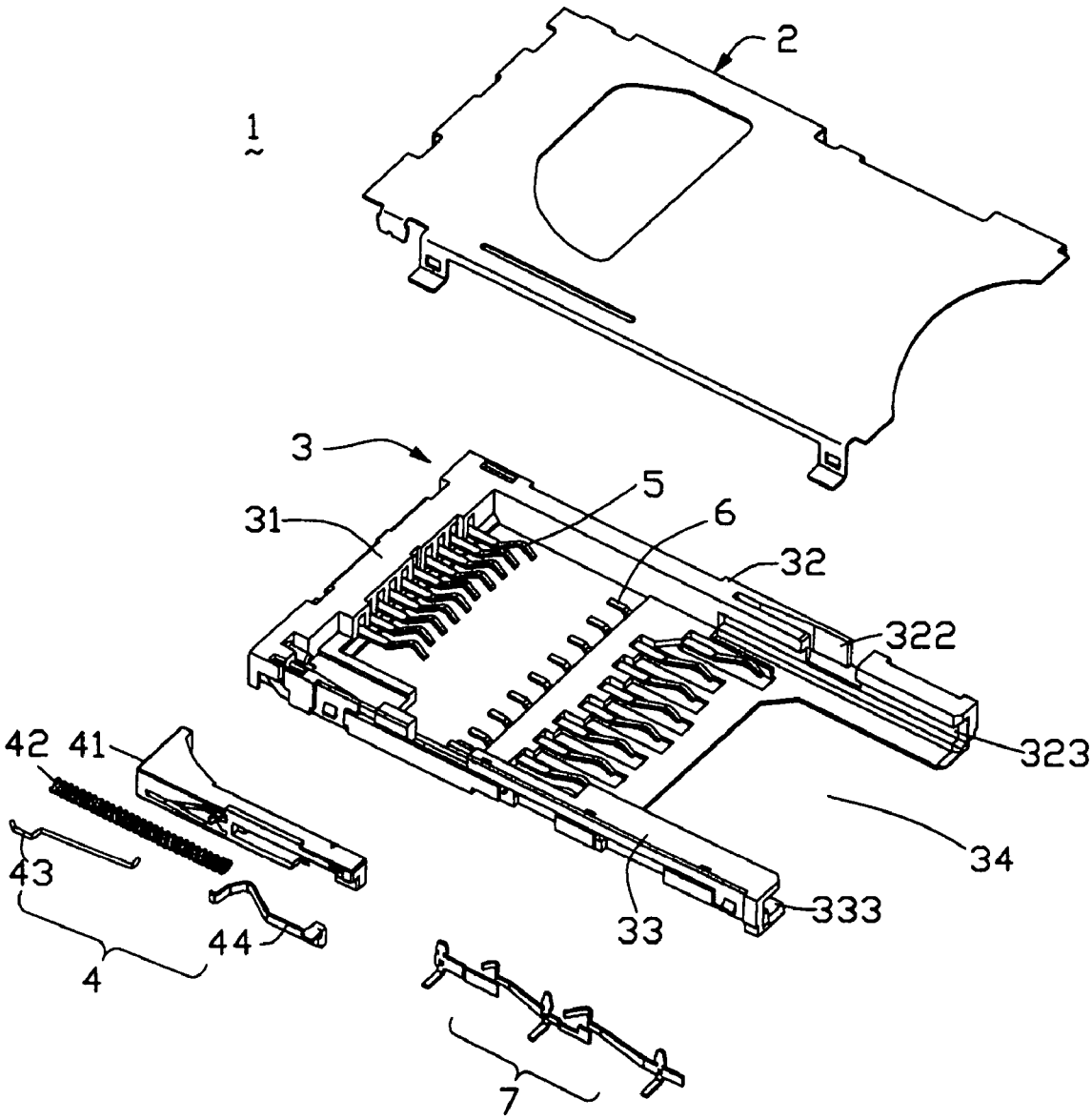
FIG. 9 PRIOR ART
FIG. 9 is an exploded perspective view showing a conventional card connector.

In conjunction with FIGS. 7–8, when the card 6 is inserted into the receiving cavity 10, the two side surfaces of the card 6 slide against the slide-guiding plate 56 of the shielding member 5. As metal is rather smoother than plastic, using the slide-guiding plates 56 made from metal for guiding the slide movement of the card 6 instead of directly defining guiding slots in the housing 1 made from plastic will largely reduce rub of the card 6, therefore increasing use life of the card 6.

However, the disclosure is illustrative only, changes may be made in detail, especially in matter of shape, size, and arrangement of parts within the principles of the invention.

What is claimed is:

1. An electrical card connector comprising:

an insulative housing having a rear wall, and first and second side walls substantially parallel extending forwards form the rear wall;

a shielding member covering on the insulative housing and defining a receiving cavity together with the first and second side walls for receiving an electrical card, said receiving cavity having a front entry from which the electrical card is inserted into the receiving cavity; and a plurality of terminals disposed in the insulative housing and having contact portions extending into the receiving cavity for contacting the electrical card;

wherein the shielding member is provided with a pair of guiding plates at the front entry of the receiving cavity and disposed between the first and second side walls for guiding the electrical card into the receiving cavity.

2. The electrical card connector as described in claim 1, wherein the insulative housing has a bottom wall connecting said rear wall and first and second side walls.

3. The electrical card connector as described in claim 1, further comprising a pair of switch terminals mounted on the second side wall of the insulative housing.

4. The electrical card connector as described in claim 1, wherein the shielding member has a pair of solder plates adapted to be soldered to a circuit board.

5. The electrical card connector as described in claim 1, wherein the guiding plates are bent inwards the receiving cavity from the front entry, and are disposed adjacent to inside surfaces of the first and second side walls respectively.

6. The electrical card connector as described in claim 5, wherein the shielding member has a pair of front shielding plates each shielding a front surface of the first and second side walls, and the guiding plate is bent from the front shielding plate.

7. The electrical card connector as described in claim 1, wherein the rear wall is formed with the post for fixing the other end of the elastic member.

* * * * *